US006757983B1

(12) United States Patent
Moon

(10) Patent No.: US 6,757,983 B1
(45) Date of Patent: Jul. 6, 2004

(54) PAVER ALIGNMENT AND SCRIBING GUIDE TOOL AND METHOD OF USE

(76) Inventor: George L. Moon, P.O. Box 267, Matamoras, PA (US) 18306

( * ) Notice: Subject to any disclaimer, the term of this patent is extended or adjusted under 35 U.S.C. 154(b) by 0 days.

(21) Appl. No.: 10/249,652

(22) Filed: Apr. 29, 2003

Related U.S. Application Data

(62) Division of application No. 09/591,240, filed on Jun. 9, 2000, now Pat. No. 6,578,279.

(51) Int. Cl.[7] ..... B43L 7/02

(52) U.S. Cl. ..... 33/481; 33/32.1; 33/474; 33/526; 33/562

(58) Field of Search ..... 33/32.1, 32.2, 33/429, 474, 481, 518, 526, 527, 562, 563, 566

(56) References Cited

U.S. PATENT DOCUMENTS

| | | | | | |
|---|---|---|---|---|---|
| 573,795 | A | * | 12/1896 | Poindexter | 33/481 |
| 1,118,067 | A | * | 11/1914 | Smith | 33/474 |
| 1,241,611 | A | * | 10/1917 | Drake | 33/518 |
| 1,495,523 | A | * | 5/1924 | MacLean | 33/32.2 |
| 3,456,353 | A | * | 7/1969 | Iams | 33/429 |
| 4,241,510 | A | * | 12/1980 | Radecki | 33/474 |
| 5,375,339 | A | * | 12/1994 | Noel, Jr. | 33/518 |
| 5,471,758 | A | * | 12/1995 | White, Sr. | 33/527 |
| 5,537,805 | A | * | 7/1996 | Allman | 33/518 |
| 5,617,642 | A | * | 4/1997 | Marios | 33/526 |
| 6,347,459 | B1 | * | 2/2002 | Schmitt | 33/518 |
| 6,578,279 | B1 | * | 6/2003 | Moon | 33/481 |

* cited by examiner

*Primary Examiner*—Diego Gutierrez
*Assistant Examiner*—Madeline Gonzalez
(74) *Attorney, Agent, or Firm*—John J. Elnitski, Jr.

(57) ABSTRACT

The present invention is a tool for scribing a paver. The tool allows for the alignment and scribing of rectangular pavers to be placed in an arc pattern. The tool includes an alignment head having a left end and a right end. A scribe guide extends from said alignment head, said scribed guide including a scribing side. A first guide pin extends from said right end of said alignment head and a second guide pin extends from said left end of said alignment head.

7 Claims, 16 Drawing Sheets

PAVER ALIGNMENT AND SCRIBING GUIDE TOOL AND METHOD OF USE

BACKGROUND OF INVENTION

There are many tools on the market for scribing pavers used as indoor and outdoor flooring. The paver to be used for the flooring is scribed, so that it may be cut to fit a desired pattern on the floor. The majority of the tools available are for making right angle cuts and 45 degree cuts to form around pavers that are diamond or hexagon shapes. One of the most difficult patterns to form using pavers 10 is an arc type of pattern, as shown in FIG. 1. The goal of the installer is to maintain the full length of a top side 11 of the pavers 10. Installers must measure or guess to make the right cuts on the outside curve 12 of pavers 10.

Measuring each paver 10 to scribe and cut increases the labor and time spent to install the outside curve 12. Guessing and even measuring leads to waste of pavers 10 which are not cut correctly.

It is an object of the present invention to provide a tool to aid in alignment of pavers in an arc type pattern.

It is an object of the present invention to provide a tool to aid in scribing pavers to be cut and fitted into an arc type pattern.

SUMMARY OF INVENTION

The present invention is a tool for scribing a paver. The tool allows for the alignment and scribing of rectangular pavers to be placed in an arc pattern. The tool includes an alignment head having a left end and a right end. A scribe guide extends from said alignment head, said scribed guide including a scribing side. A first guide pin extends from said right end of said alignment head and a second guide pin extends from said left end of said alignment head.

DETAILED DESCRIPTION

Figure 1:
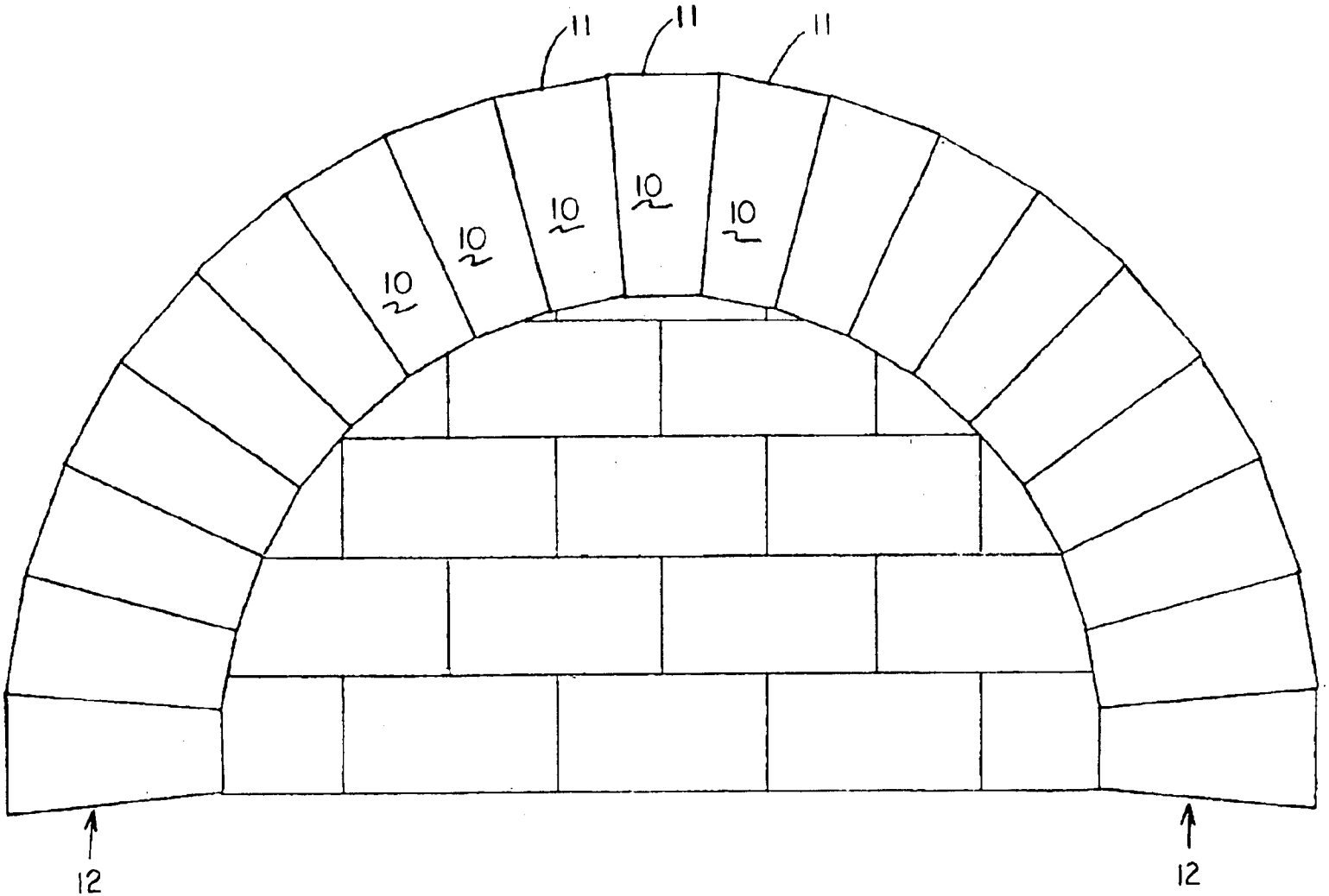
FIG. 1 is a top view of a finished arc of pavers.
Figure 2:
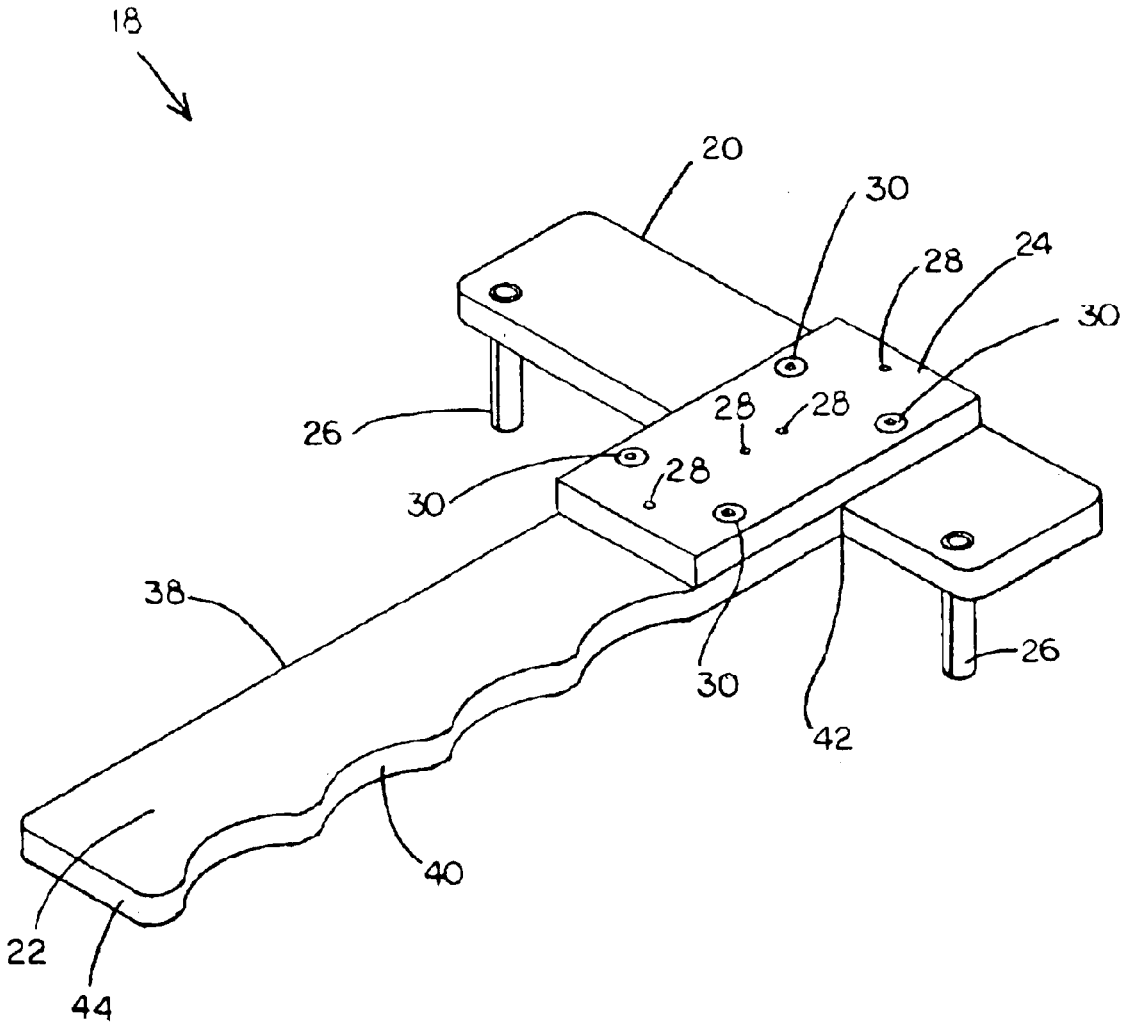
FIG. 2 is a perspective view of a tool according to the present invention.
Figure 3:
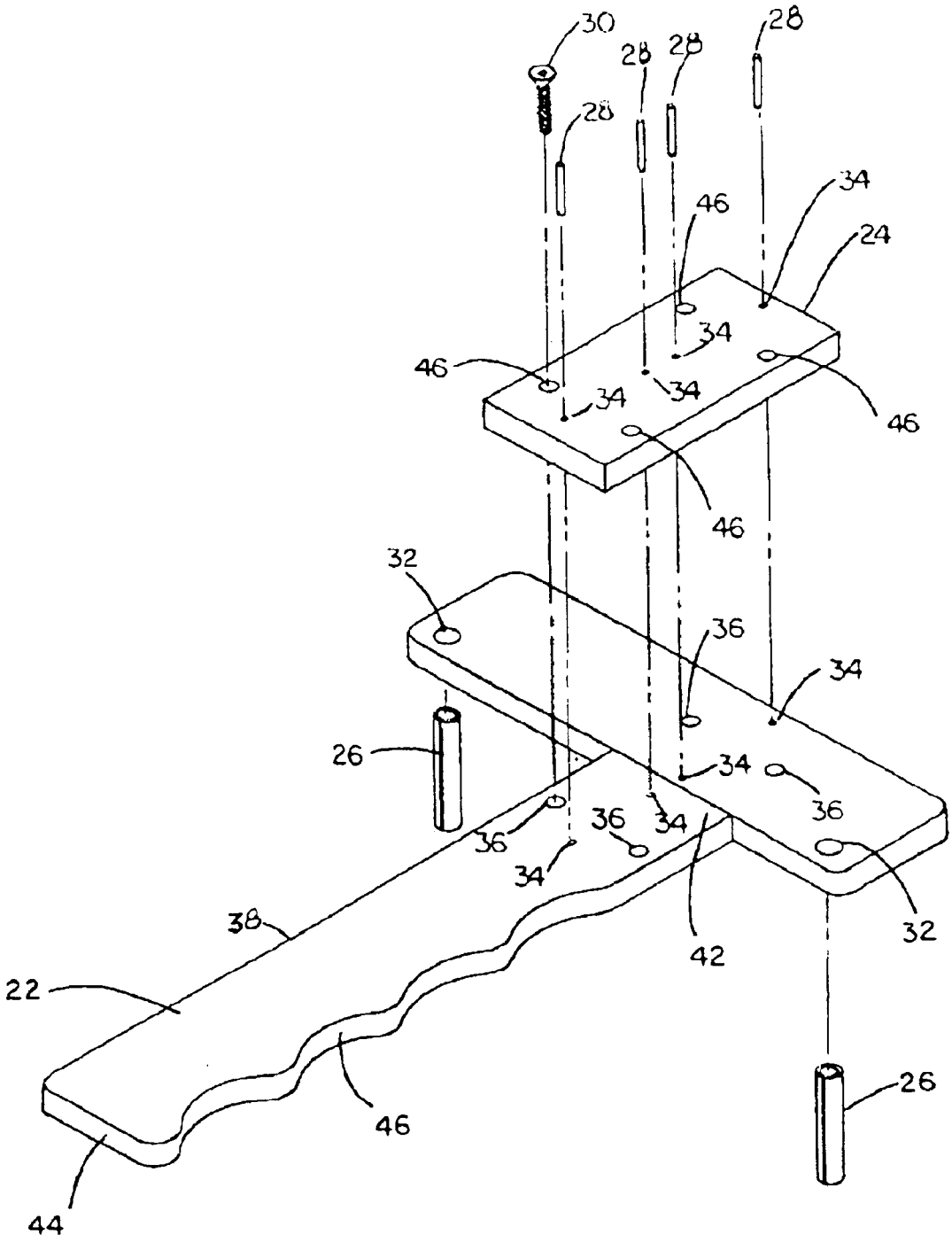
FIG. 3 is an exploded view of a tool according to the present invention.

The present invention is a tool 18 for the alignment and scribing of pavers 10 to be placed in an arc pattern, as shown in FIG. 1. The pavers 10 shown are the standard 4"×8" size. The tool 18 includes an alignment head 20, scribing guide 22, attachment plate 24, guide pins 26, fastening pins 28 and fasteners 30, as shown in FIGS. 2–3. The alignment head 20, scribing guide 22 and attachment plate 24 are basically rectangular in shape and can be made from a light weight metal such as aluminum. The alignment head 20, scribing guide 22 and attachment plate 24 are of a general thickness to withstand general use at a job site and to provide an edge for scribing. The alignment head 20 includes two guide pin holes 32, two fastening pin holes 34 and two threaded holes 36. The scribing guide 22 includes a scribing side 38, a hand grip side 40, a top end 42 and a bottom end 44. The top end 42 of the scribing guide 22 includes two fastening pin holes 34 and two threaded holes 36. The hand grip side 40 is contoured to allow the hand of the installer to grip the tool 18. Also, because the grip side 40 is contoured, the user can not mistakenly use the grip side 40 instead of the scribing side 38. The attachment plate 24 includes four fastening pin holes 34 and four fastener holes 46.

The guide pins 26 are shown as roll pins inserted into the guide pin holes 32 of the alignment head 20. The scribing guide 22 is perpendicular to and extends downward from the alignment head 20, such that the scribing side 38 is equal distance between the guide pins 26. The two fastening pin holes 34 and two threaded holes 36 on the alignment head 20 are positioned to be inline with the fastening pin holes 34 and two threaded holes 36 of the scribing guide 22. The attachment plate 24 is placed on top of the alignment head 20 and scribing guide 22. The fastening pins 28 and fasteners 30 secure the alignment head 20, scribing guide 22 and attachment plate 24 together, in order to form the tool 18. The fastening pins 28 are driven into the fastening pin holes 34 of the attachment plate 24 and on into the respective fastening pin holes 34 of the alignment head 20 and scribing guide 22. The fasteners 30 are shown as screws, which are inserted into the fastener holes 46 of the attachment plate 24 and threaded into the threaded holes 36 of the alignment head 20 and scribing guide 22.

Figure 4:
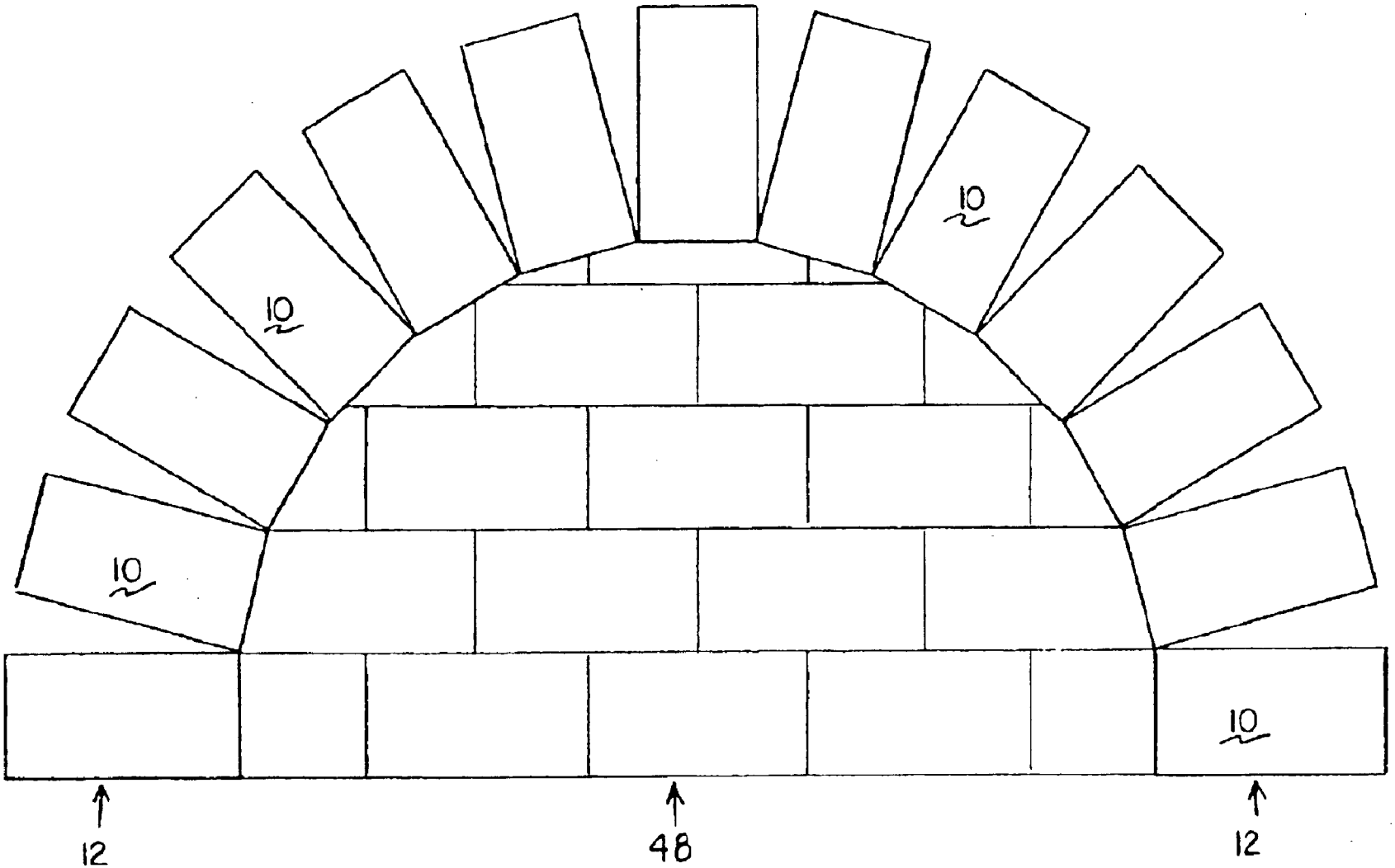
FIG. 4 is a top view of an unfinished arc of pavers.
Figure 5:
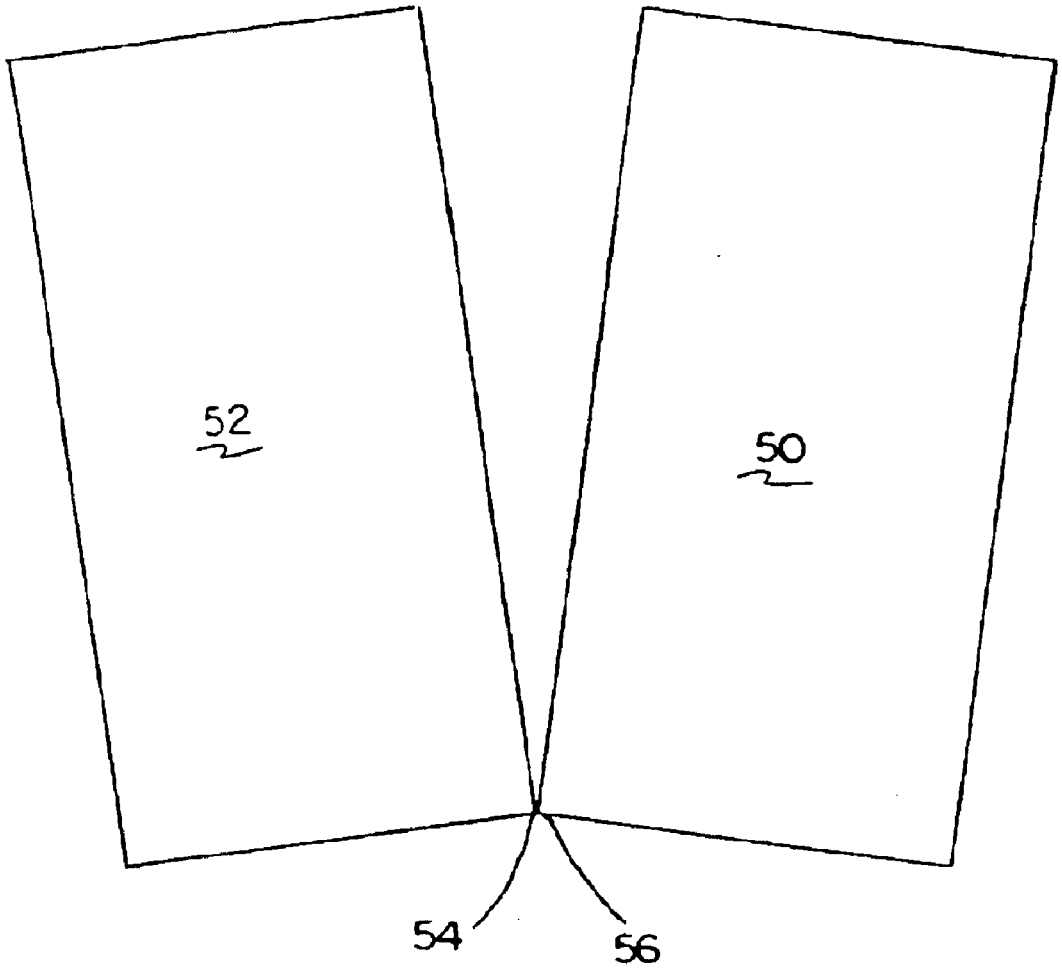
FIG. 5 is a top view of two uncut pavers.
Figure 6:
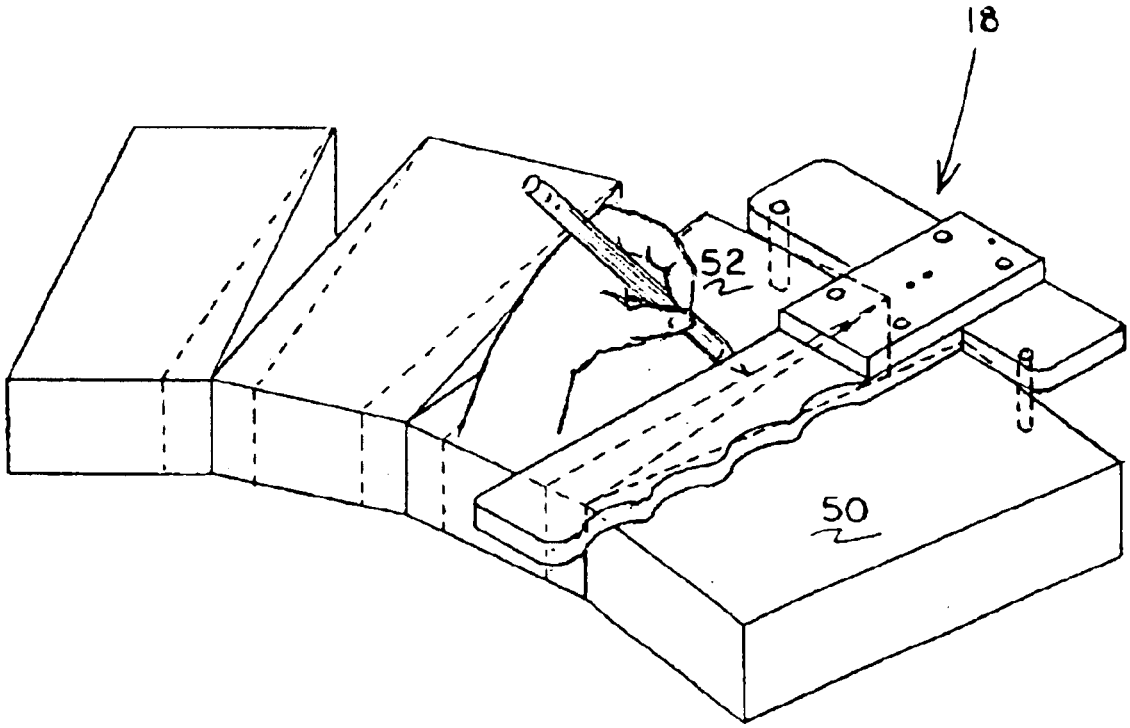
FIG. 6 is a perspective view of using the tool according to the present invention.
Figure 7:
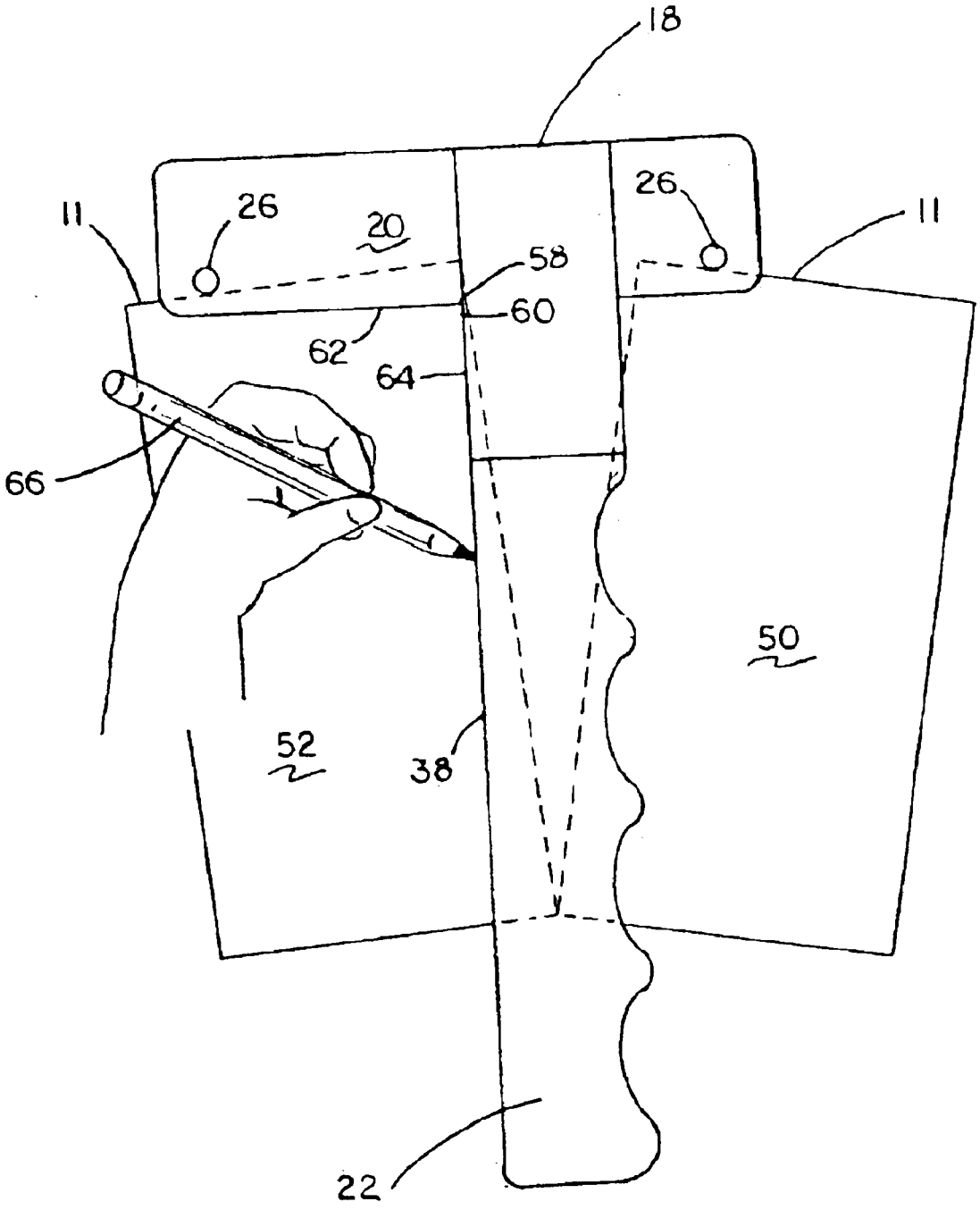
FIG. 7 is a top view of using the tool according to the present invention.

The following is a method of use of the tool 18, which is shown in FIGS. 4–14. To achieve the arc pattern of the outside curve 12 of pavers 10 as shown in FIG. 1, the installer starts with standard rectangular pavers 10 against an arced surface 48, as shown in FIG. 4. FIG. 5 shows a close up of two of the pavers 10, whereby there is a right hand paver 50 and a left hand paver 52. The bottom right hand corner 54 of the left hand paver 52 is shown touching the bottom left hand corner 56 of the right hand paver 50. FIG. 6 shows an overall concept drawing of using the tool 18 to align and scribe the pavers 50, 52. FIG. 7 show the first step of using the tool 18. The first step is to place the tool 18 over the right hand paver 50 and left hand paver 52 such that the guide pins 26 contact the top side 11 of each paver 50, 52. The tool 18 is placed whereby an inside marking corner 58 of the tool 18 is positioned at the right hand side 60 of the left hand paver 52, near the top side 11 of the left hand paver 52. The inside marking corner 58 is where the scribing side 38 of the scribe guide 22 meets the bottom side 62 of the alignment head 20. Then, the installer scribes a line 64 on the left hand paver 52 with a scribe 66 along the scribe side 38 of the scribe guide 22, as shown in FIG. 7.

Figure 8:
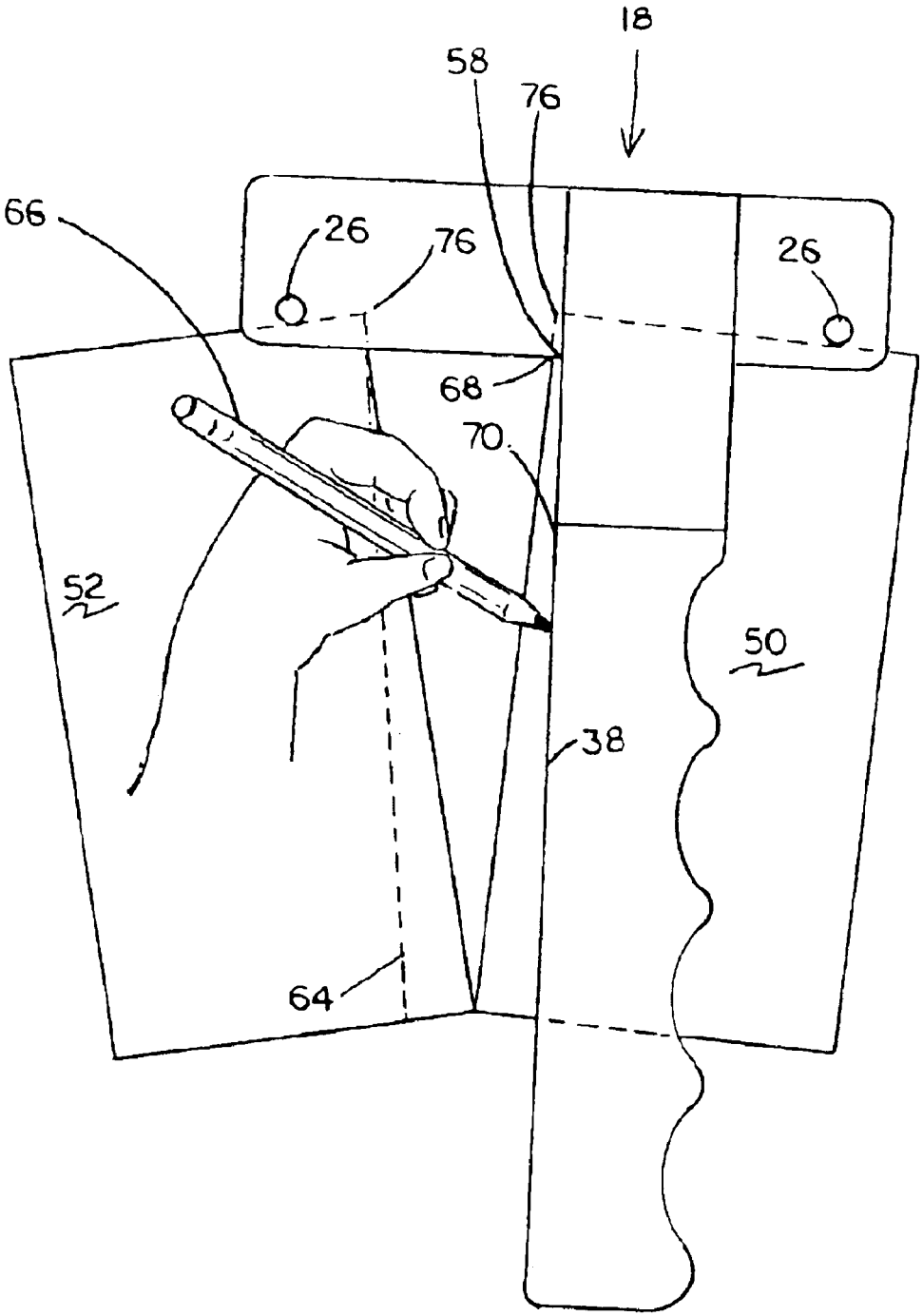
FIG. 8 is a top view of using the tool according to the present invention.
Figure 9:
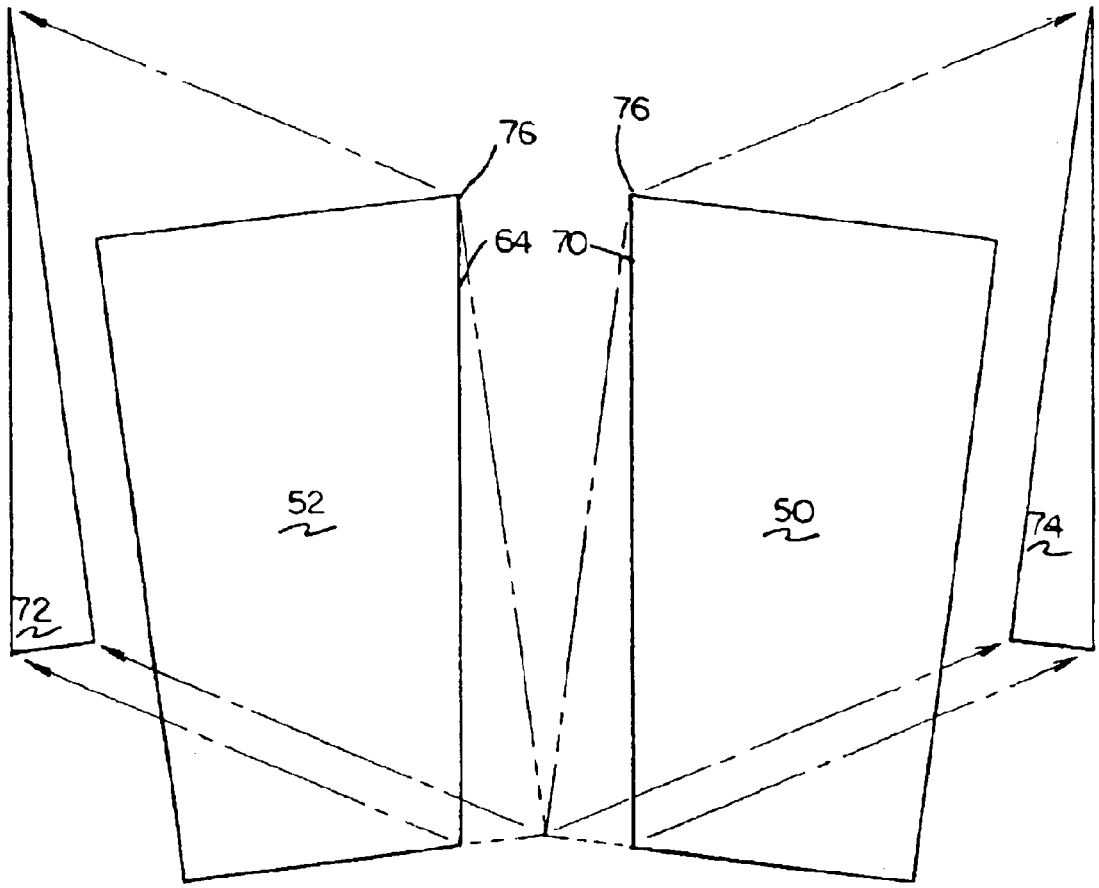
FIG. 9 is a top view showing portions of the pavers removed.
Figure 10:
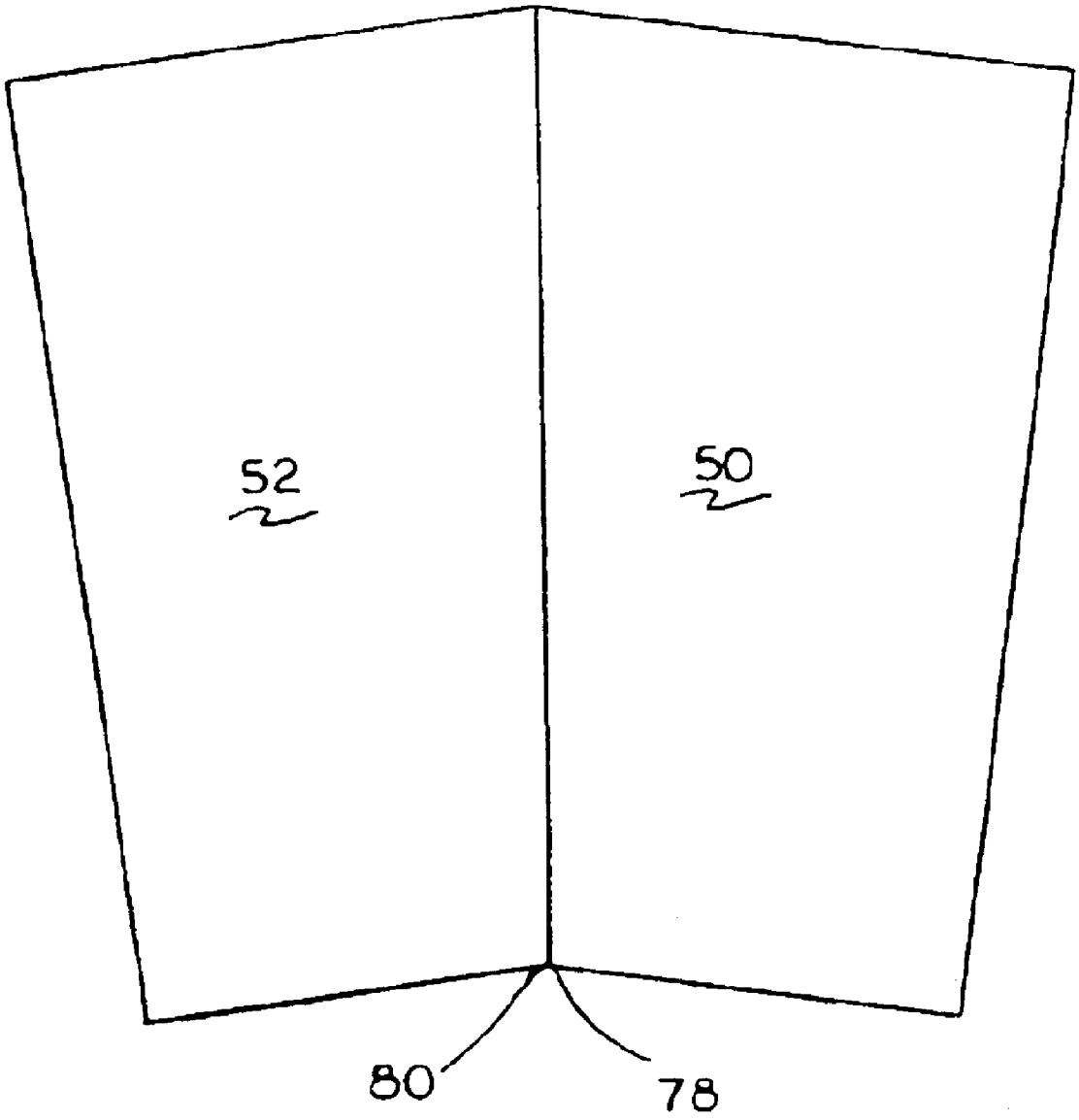
FIG. 10 is a top view showing the pavers assembled in an arc.

FIG. 8 shows the next step, where the tool 18 is placed over the right hand paver 50 and left hand paver 52 such that the guide pins 26 contact the top side 11 of each paver 50, 52. The tool 18 is placed whereby the inside marking corner 58 of the tool 18 is positioned at the left hand side 68 of the right hand paver 50, near the top side 11 of the right hand paver 50. Then, the installer scribes a line 70 on the right hand paver 50 with the scribe 66 along the scribe side 38 of the scribe guide 22, as shown in FIG. 8. FIG. 9 shows the next step, where a right hand portion 72 of the left hand paver 52 and a left hand portion 74 of the right hand paver 50 are removed along the lines 64, 70. The right hand and left hand portions 72, 74 are removed by cutting the pavers 50, 52 along the lines 64, 70, whereby the beginning of the cutting is estimated from the top corners 76 to where the lines 64, 70 begin at the sides 60, 68 of the pavers 50, 52. After the left hand and right hand portions 72, 74 are removed, the next step is to move the right hand paver 50 against the left hand paver 52. The right hand paver 50 is moved such that a new bottom left hand corner 78 of the right hand paver 50 is touching a new bottom right hand corner 80 of the left hand paver 52. As can be seen from FIG. 10, the cut right side of the left hand paver 52 and cut left side of the right hand paver 50 fit together, whereby the total face of the top side 11 of both pavers 50, 52 is retained. This method is performed on all of the pavers 10 to achieve the outside curve 12 of the arc shown in FIG. 1.

Figure 11:
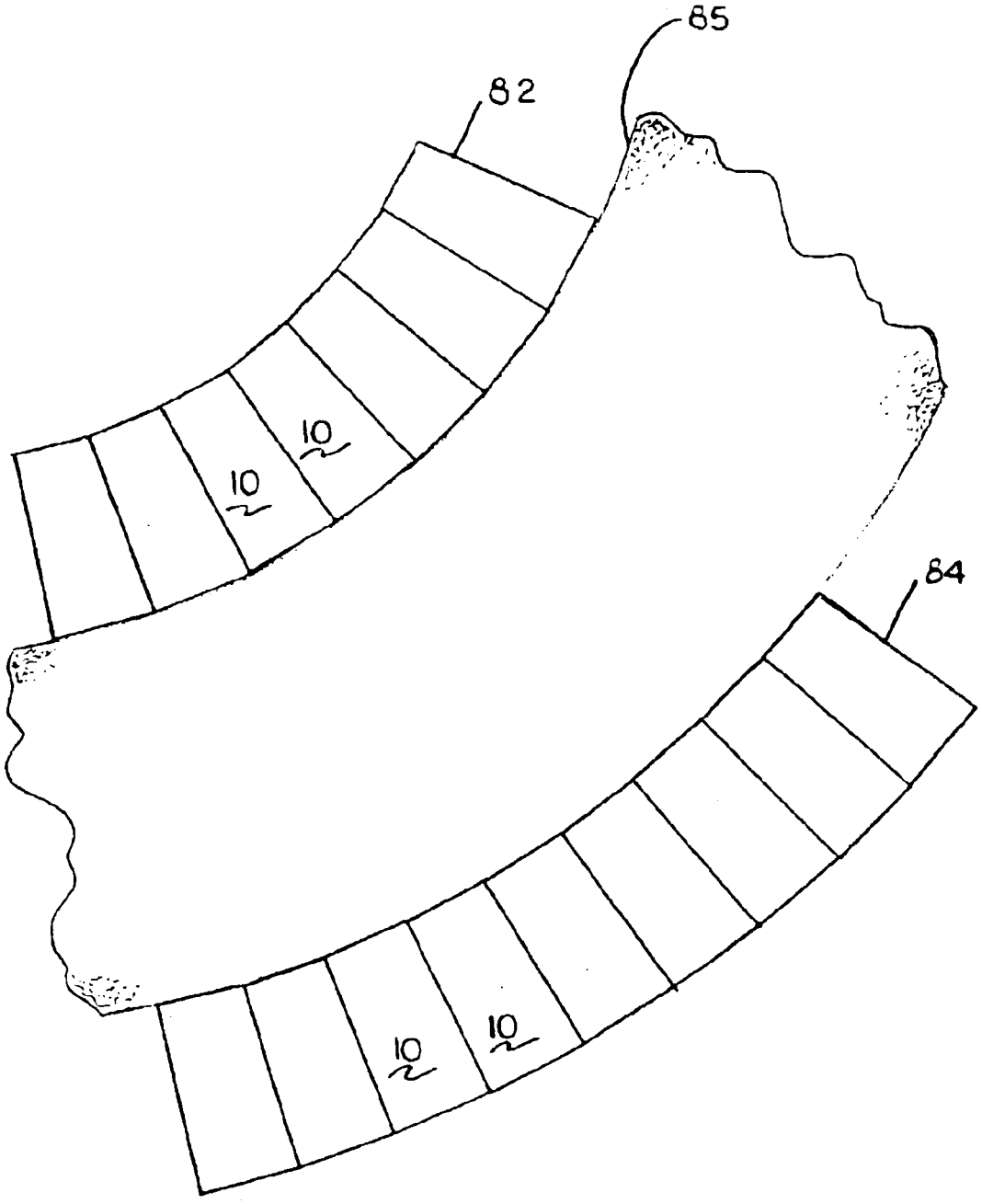
FIG. 11 is a top view of a finished arc of pavers having an inside curve.
Figure 12:
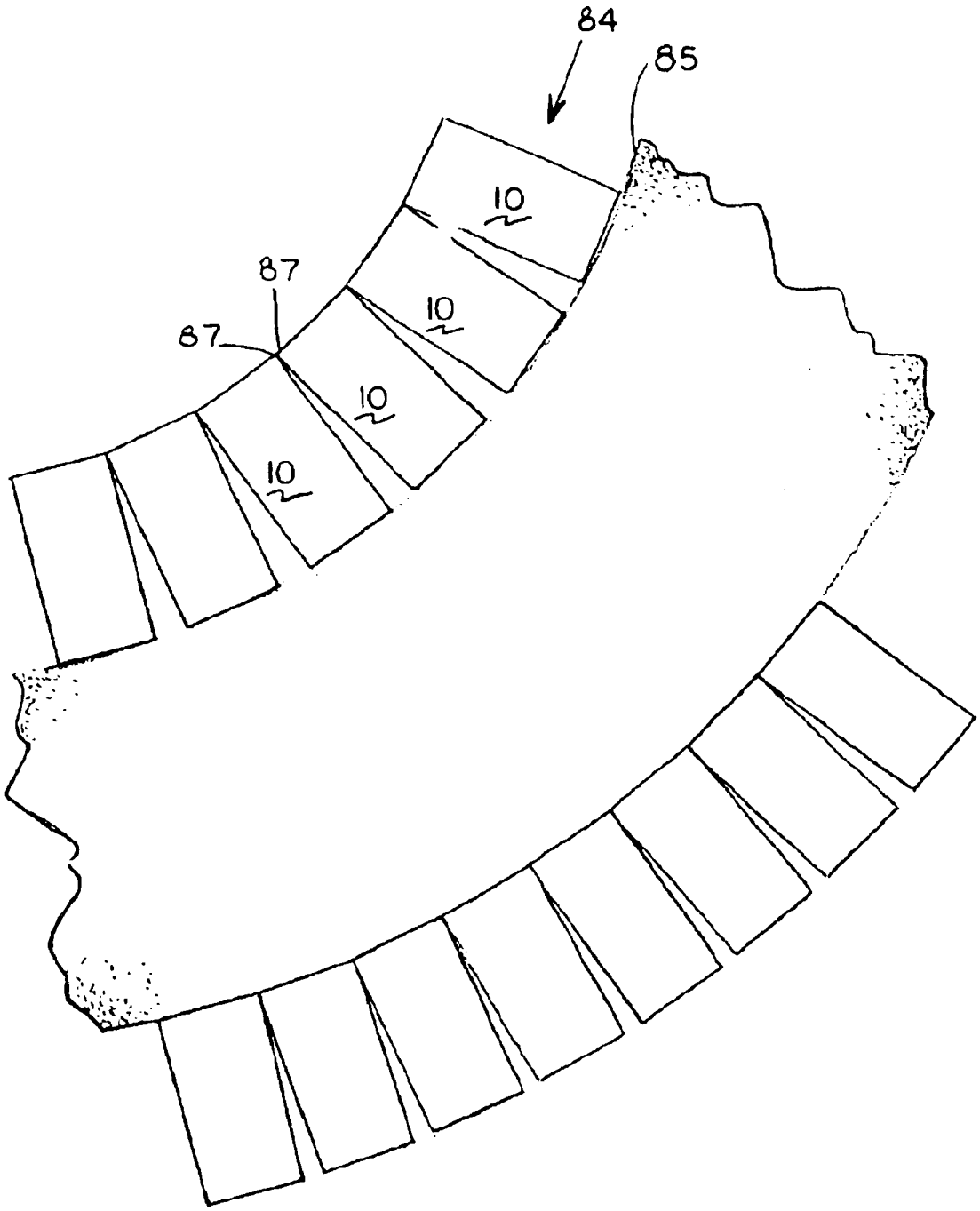
FIG. 12 is a top view of an unfinished arc of pavers having an inside curve.
Figure 13:
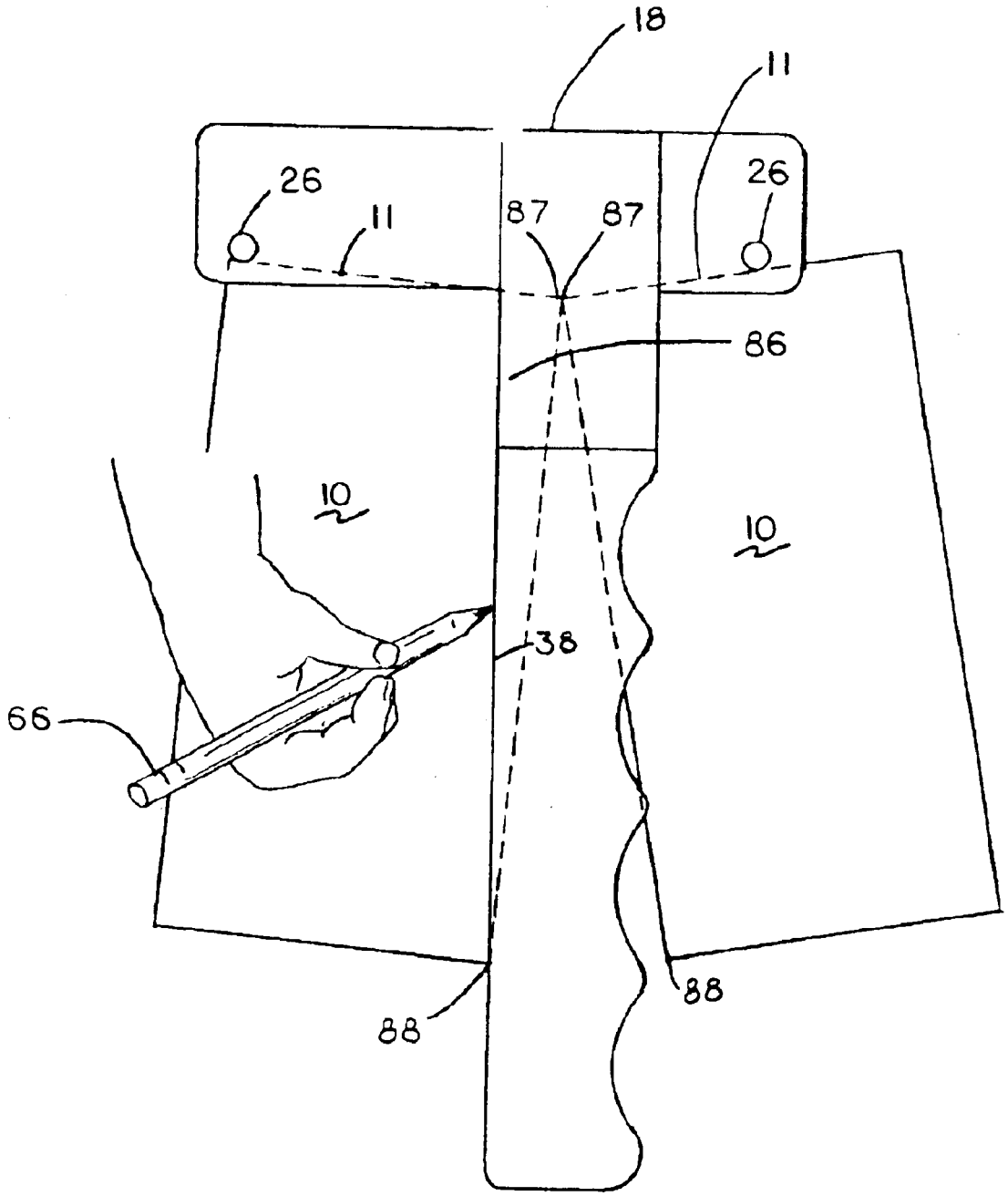
FIG. 13 is a top view of using the tool according to the present invention.
Figure 14:
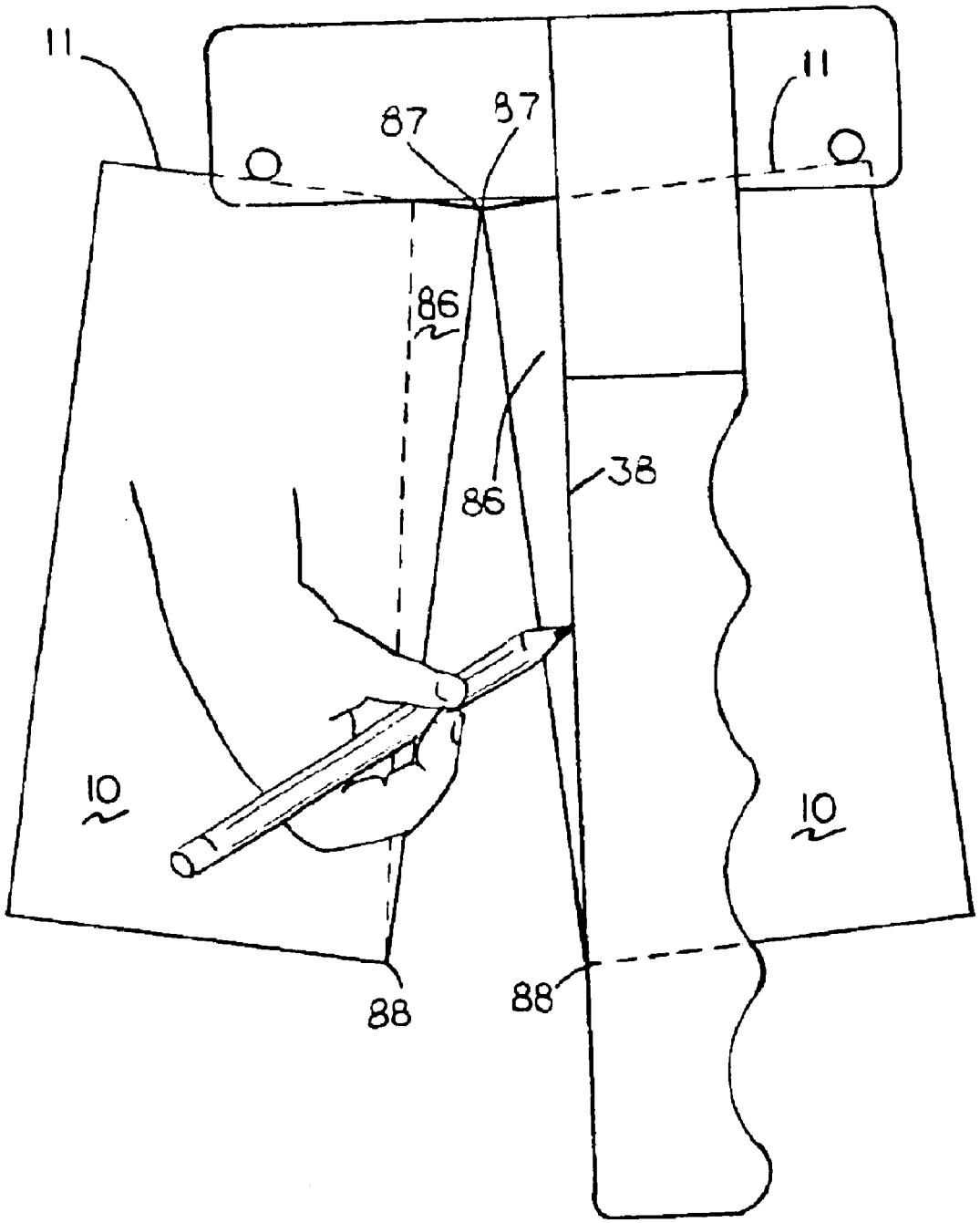
FIG. 14 is a top view of using the tool according to the present invention.

FIGS. 11–14 show the use of the tool for cutting pavers 10 for an inside curved arc 82 as oppose to the outside curve 12 of pavers 10. FIG. 11 shows the finished inside curved arc 82 along with the finished outside curved arc 84. FIG. 12 shows the pavers 10 positioned in the arc against an arced surface 85, before the pavers 10 are cut. FIGS. 13–14 show how to position the tool 18 and scribe both lines for the removal of portions 86 of the pavers 10. In this case, the top side corners 87 of the pavers 10 are touching. The tool 18 is position such that the guide pins 26 are against the top sides 11 of the pavers 10. The lines are marked by aligning the scribing side 38 of the tool 18 with the bottom corner 88 of each paver 10 and scribing the lines. Finally, the portions 86 are removed by cutting along the lines and the pavers 10 are pushed together, as describe above for the outside curve 12.

Figure 15:
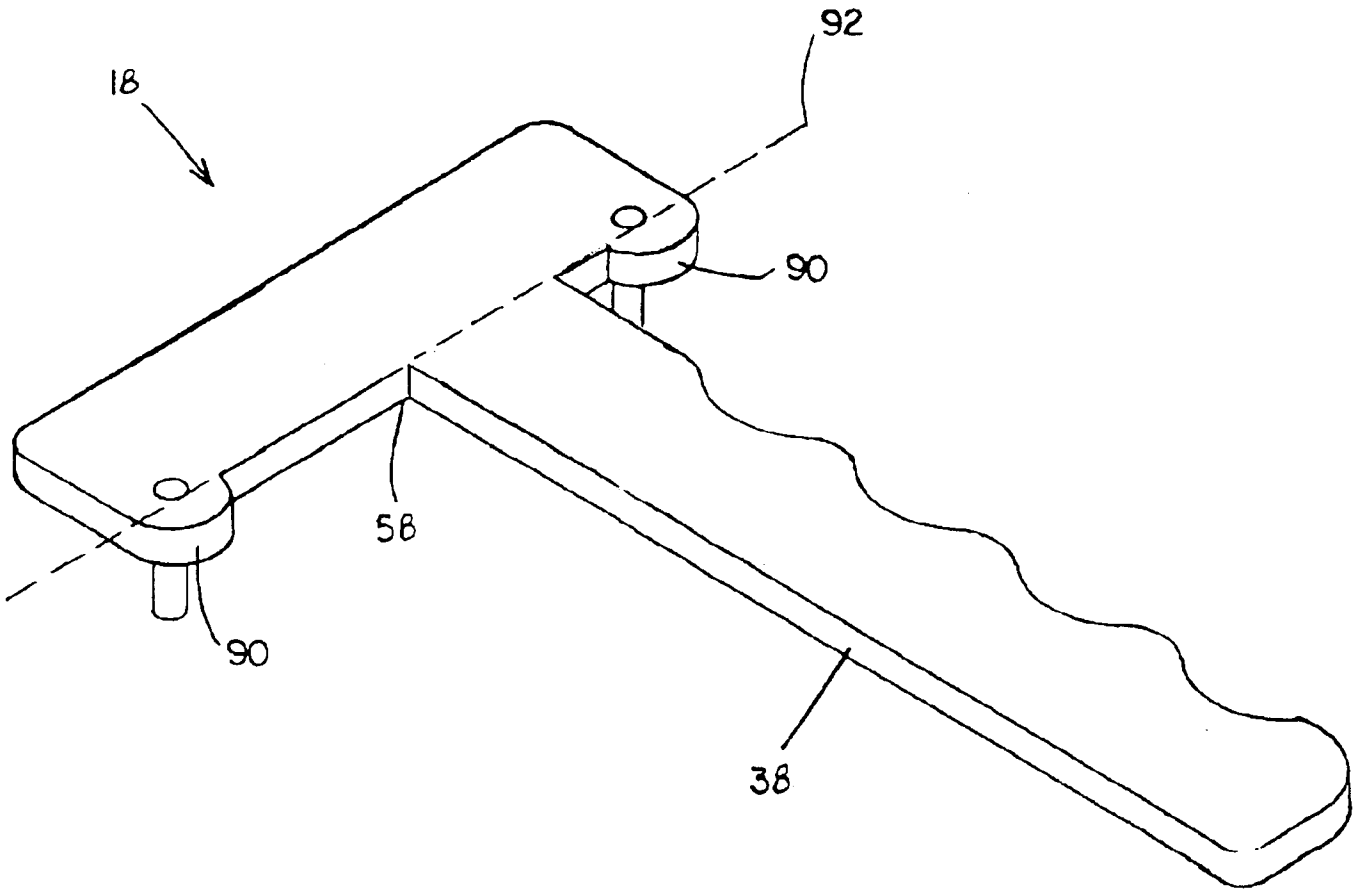
FIG. 15 is a perspective view of a different embodiment of the tool according to the present invention.
Figure 16:
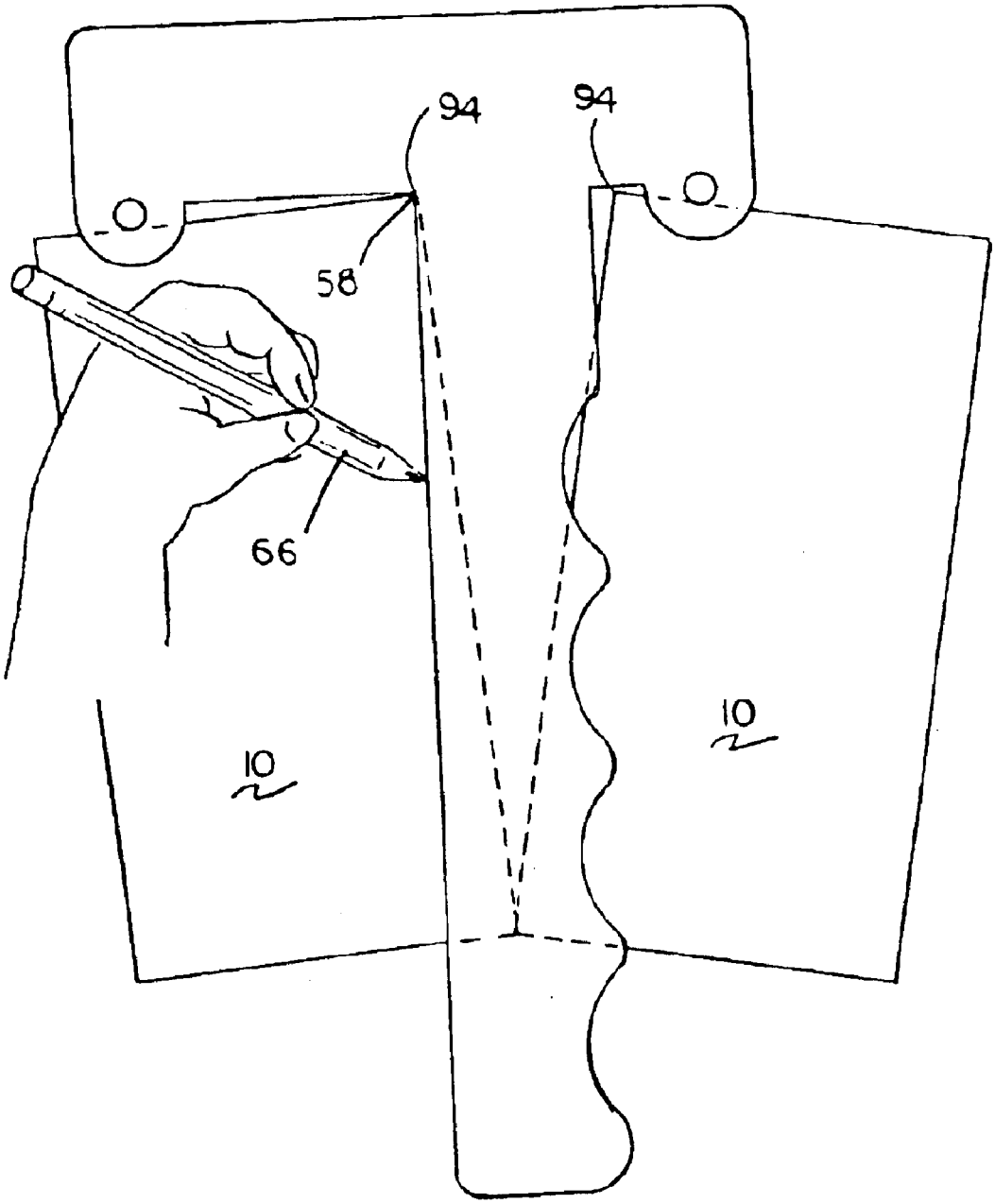
FIG. 16 is a top view of using the different embodiment of the tool of FIG. 15 according to the present invention.

FIGS. 15–16 show a different embodiment of the present invention. FIG. 15 shows the tool 18 made as a one piece design. FIG. 15 also shows ears 90 extending downward from the alignment head 20. The ears 90 provide extra material on the tool 18 to position the guide pins 26, such that an outside surface of the guide pins 26 is aligned with the Inside marking corner 58, as shown by dotted line 92. This allows the inside marking corner 58 to be positioned over the top corners 94 of the paver 10, as shown in FIG. 16. Aligning the inside marking corner 58 of the tool 18 with the top corner 94 of the paver 10, instead of the side of the paver 10, allows a line to drawn which eliminates the estimating step when cutting the part of the paver 10 not marked by the scribe 66.

While different embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention which is to be given the full breadth of any and all equivalents thereof.

What is claimed is:

1. A tool for scribing a rectangular pavers, said tool adapted to allow scribing of the pavers such that the pavers can be cut and fitted together in a curve where the pavers have a top side, bottom side and a left hand side and right hand side which connect the bottom and top sides, comprising:

an alignment head having a left end, a right end, front face which faces the user and a rear face which lays against a surface of the pavers;

a scribe guide extending from said alignment head, said scribe guide including a scribing side, front face which faces the user and a rear face which lays against the surface of at least one of the pavers, said scribing side extending up from said rear face, thereby putting said scribing side in direct contact with the surface of at least one of the pavers;

a first guide pin extending from said rear face of said right end of said alignment head, said first guide pin used to contact the top side of a first paver to be scribed;

a second guide pin extending from said rear face of said left end of said alignment head, said first guide pin used to contact the top side of a second paver to be scribed; and said first guide pin and said second guide pin positioned in relation to said alignment head and scribing side such that said first guide pin contacts the top side of the first paver and said second guide pin contacts the top side of the second paver when a bottom right hand corner of the second paver is touching a bottom left hand corner of the first paver.

2. The tool of claim 1, wherein said scribing side is perpendicular to a line formed between said guide pins.

3. The tool of claim 2, wherein said scribing side is positioned equal distance between said guide pins.

4. The tool of claim 1, further including ears extending from said alignment head to hold said guide pins, said guide pins positioned in said ears such that a surface of said guide pins, closest to the direction that said scribe guide extends from said alignment head, is aligned with an inside marking corner formed by said scribing side and said alignment head.

5. A tool for scribing rectangular pavers, said tool adapted to allow scribing of the pavers such that the pavers can be cut and fitted together in a curve where the pavers have a top side, bottom side and a left hand side and right hand side which connect the bottom and top sides, comprising:

an alignment head having a left end, a right end, front face which faces the user and a rear face which lays against a surface of the paver;

a scribe guide extending from said alignment head, said scribe guide including a scribing side, front face which faces the user and a rear face which lays against the surface of at least one of the pavers, said scribing side extending up from said rear face thereby putting said scribing side in direct contact with the surface of at last one of the pavers;

a first guide pin extending from said rear face of said right end of said alignment head, said first guide pin used to contact the top side of a first paver to be scribed;

a second guide pin extending from said rear face of said left end of said alignment head, said first guide pin used to contact the top side of a second paver to be scribed;

said first guide pin and said second guide pin positioned in relation to said alignment head and scribing side such that said first guide pin contacts the top side of the first paver and said second guide pin contacts the top side of the second paver when a bottom right hand corner of the second paver is touching a bottom left hand corner of the first paver; and ears extending from said alignment head to hold said guide pins, said guide pins positioned in said ears such that a surface of said guide pins, closest to the direction that said scribe guide extends from said alignment head, is aligned with an inside marking corner formed by said scribing side and said alignment head.

6. The tool of claim 5, wherein said scribing side is perpendicular to a line formed between said guide pins.

7. The tool of claim 5, wherein said scribing side is positioned equal distance between said guide pins.

* * * * *